United States Patent [19]

Shannon et al.

[11] Patent Number: 4,890,353

[45] Date of Patent: Jan. 2, 1990

[54] PAINT BRUSH AND PAINT ROLLER HOLDER

[76] Inventors: Gilbert A. Shannon, 800 Stewart St.; Betty L. Hines, 801 Stewart St., both of Englewood, Fla. 34223

[21] Appl. No.: 242,049

[22] Filed: Sep. 8, 1988

Related U.S. Application Data

[63] Continuation-in-part of Ser. No. 174,227, Mar. 28, 1988, abandoned.

[51] Int. Cl.[4] ..... A47G 29/00

[52] U.S. Cl. ..... 15/257 R; 248/110; 206/361; 211/65; 211/66

[58] Field of Search ..... 15/230.11, 257; 134/135; 211/65, 66; 248/110; 206/361; 220/90

[56] References Cited

U.S. PATENT DOCUMENTS

| | | | |
|---|---|---|---|
| 2,472,058 | 6/1949 | Artley | 211/66 X |
| 2,950,012 | 8/1960 | Mascaretti | 211/65 |
| 4,266,746 | 5/1981 | Klaiber | 15/257 R |
| 4,561,556 | 12/1981 | Bendix | 206/361 X |

*Primary Examiner*—Frankie L. Stinson
*Attorney, Agent, or Firm*—Charles J. Prescott

[57] ABSTRACT

A paint brush and paint roller holder adapted to be releasably connectable onto the upright end wall of a paint tray. In one embodiment, the invention includes cooperating first and second molded members which are cooperatively clampable together on either side of the flange and end wall of the paint tray. The preferred embodiment is integrally molded as a single member. A generally horizontally disposed platform is positioned above the paint tray structured to support both a paint brush and paint roller separately, allowing free access to the paint by either brush or roller, and facilitating paint drippings therefrom to freely fall back into the paint tray. The upright main portion is structured to include lines of weakness for breaking away the portions therebelow to accommodate various standard paint tray depths.

11 Claims, 3 Drawing Sheets

Fig. 1
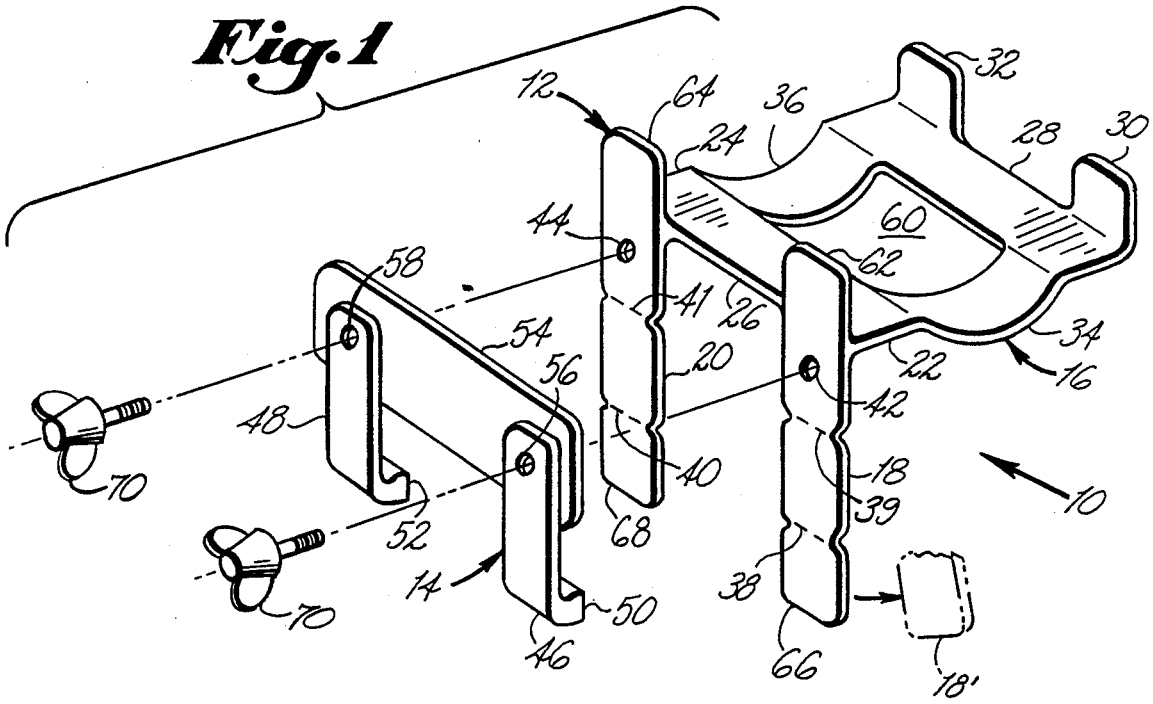
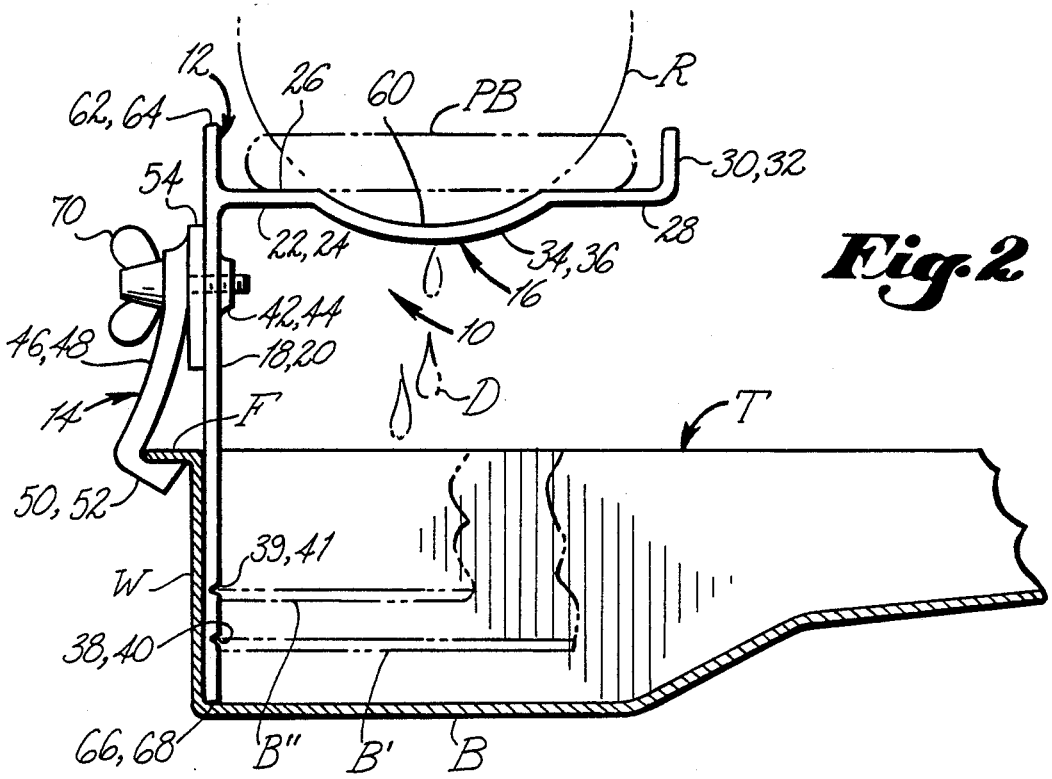
Fig. 2

PAINT BRUSH AND PAINT ROLLER HOLDER

BACKGROUND OF THE INVENTION

This is a continuation-in-part application of application Ser. No. 174,227 filed Mar. 28, 1988 and now abandoned.

This invention relates generally to devices for supporting paint brushes and paint rollers, and particularly to a paint brush and paint roller holder adapted to be clampably engageable onto the flange and end wall of a paint tray.

The majority, if not virtually all, of the interior painting done by both homeowners and professionals requires both the use of a paint brush and a paint roller. Obviously, the majority of users are unable to manipulate both devices simultaneously, which talent is likewise unnecessary, in order to accomplish coating walls and ceilings completely and effectively with fresh paint. Therefore, at any given point in the painting process, the user requires only one of these utensils at a time to continue the painting process. In order to avoid the distraction of holding the currently not-in-use utensil, a convenient place to rest same is desirable. Further such a resting place for the not-in-use utensil should accommodate both brushes and rollers while also not inhibiting free access to paint in the tray. It is also a desirable feature of the resting place that it facilitate drainage of paint drippings from the brush and roller back into the paint tray for reuse.

Prior art discloses a number of inventions which have attempted to address the above-referenced problem and desired features but, for various reasons, have failed to fully satisfy all of the above-described aspects of this problem. One very early invention in Domagola U.S. Pat. No. 731,289 discloses a combination painter's brush wiper and holder which appears to resolve some of these difficulties with respect to paint brushes only. Another device disclosed in Jenkins U.S. Pat. No. 3,291,337 teaches a wire-formed brush holder and wiper attachable again only to a paint can which appears to be somewhat cumbersome and unsupportive of the paint brush itself.

Yet another invention to Church in U.S. Pat. No. 4,275,818 discloses a paint brush holder and wiper which disposes the paint brush itself at an acute angle above and over the paint can. Although claimed to be adaptable to rollers and paint trays, the invention disclosed in Bendix U.S. Pat. No. 4,561,556 appears primarily adapted for use in conjunction with paint cans wherein the paint brush support itself is disposed adjacent the paint can, relying on a small, easily clogged aperture which is positioned over the paint can for the return of paint drippings.

Applicants are also aware of the following additional prior art:

#2,887,705: Serwer
#2,932,838: Ouellette
#2,950,012: Mascaretti
#3,947,135: Hawk
#4,025,205: Hawk
#4,352,477: Garrette The present invention discloses a simple, economical to manufacture, and easily installable device adapted for use specifically in conjunction with all depths of paint trays which will support both a paint brush and a roller separately and which will redeposit paint drippings back into the paint supply while remaining clear of free access to the paint by both paint brush and paint roller while the other is resting atop the invention while not in use.

BRIEF SUMMARY OF THE INVENTION

This invention is directed to a paint brush and paint roller holder adapted to be releasably connectable onto the upright end wall of a paint tray. In one embodiment, the invention includes cooperating first and second molded members which are cooperatively clampable together on either side of the flange and end wall of the paint tray. The preferred embodiment is integrally molded as a single member. A generally horizontally disposed platform is positioned above the paint tray structured to support both a paint brush and paint roller separately, allowing free access to the paint by either brush or roller and facilitating paint drippings therefrom to freely fall back into the paint tray. The upright main portion is structured to include lines of weakness for breaking away the portions therebelow to accommodate various standard paint tray depths.

It is therefore an object of this invention to provide a paint brush and paint roller holder adapted to be connectable onto the flange and end wall of a paint tray.

It is another object of this invention to provide a paint brush and paint roller holder which conveniently redeposits paint drippings back into the paint reservoir in the paint tray.

It is yet another object of this invention to provide a paint brush and paint roller holder which is fully functional to satisfy the above objects and which does not interfere with free access into the paint reservoir by both brush and roller.

It is yet another object to provide the above invention which is easily and economically manufactured and installable for use.

It is yet another object of the above invention to be adaptable to all standardized depths of paint trays.

In accordance with these and other objects which will become apparent hereinafter, the instant invention will now be described with reference to the accompanying drawings in which:

BRIEF DESCRIPTION OF THE DRAWINGS

FIG. 1 is an exploded perspective view of one embodiment of the invention.

FIG. 2 is a right side elevation view of the invention in FIG. 1 connected onto the end wall of a conventional paint tray partially shown in section, other paint tray depths partially shown in phantom.

DETAILED DESCRIPTION OF THE INVENTION

Figure 3:
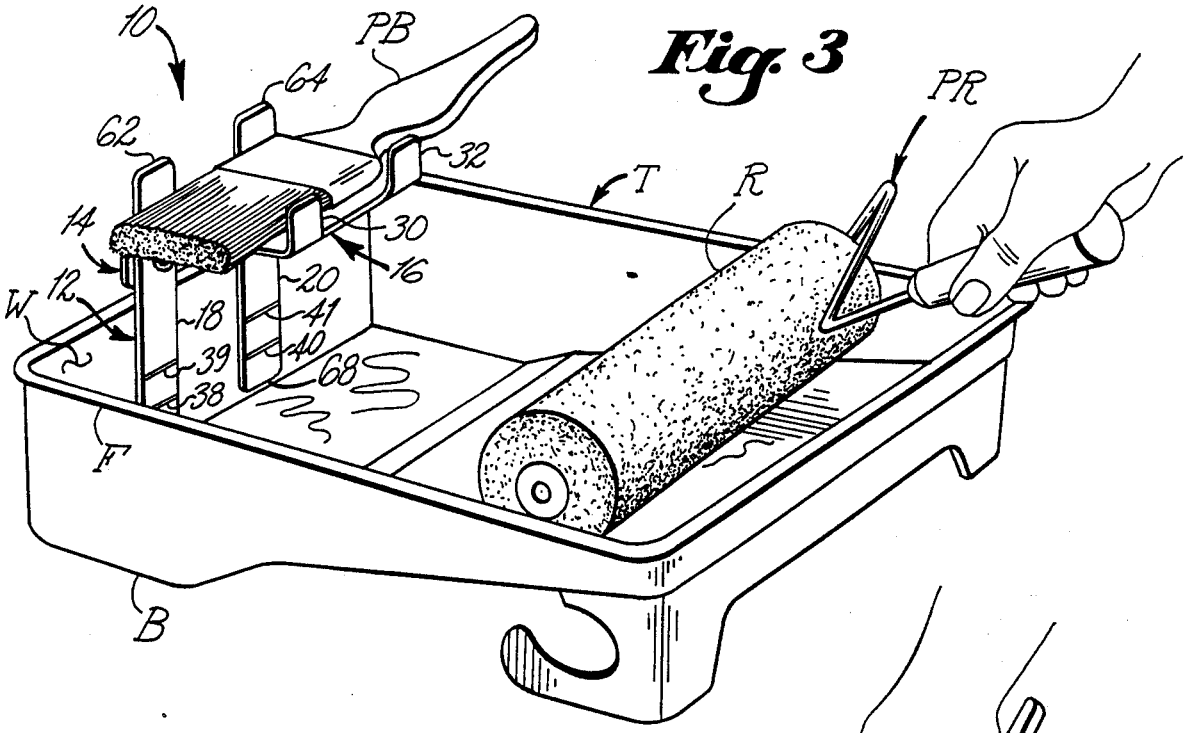
FIG. 3 is a perspective view of the invention in FIG. 1 in one mode of its use.

Referring now to the drawings, the preferred embodiment of the invention is shown generally at 10 and includes a first molded member 12 and a second molded plastic member 14. The first molded member 12 generally includes a pair of upright spaced apart legs 18 and 20 connected by and having perpendicularly disposed from adjacent their upper ends platform 16. Platform 16 includes longitudinal members 26 and 28 which are interconnected at their ends by transverse members 34 and 36.

The upper ends 62 and 64 of legs 18 and 20 extend above platform 16 and cooperate with opposing upwardly extending edge portions 30 and 32 to prevent a paint brush or roller placed atop the platform 16 from falling or inadvertently being jostled therefrom. Likewise, a centrally located longitudinal concavity formed into transverse members 34 and 36 serves to support and laterally stabilize and position the roller head R of a conventional paint roller RP placed thereatop as best seen in FIGS. 2 and 4.

Figure 4:
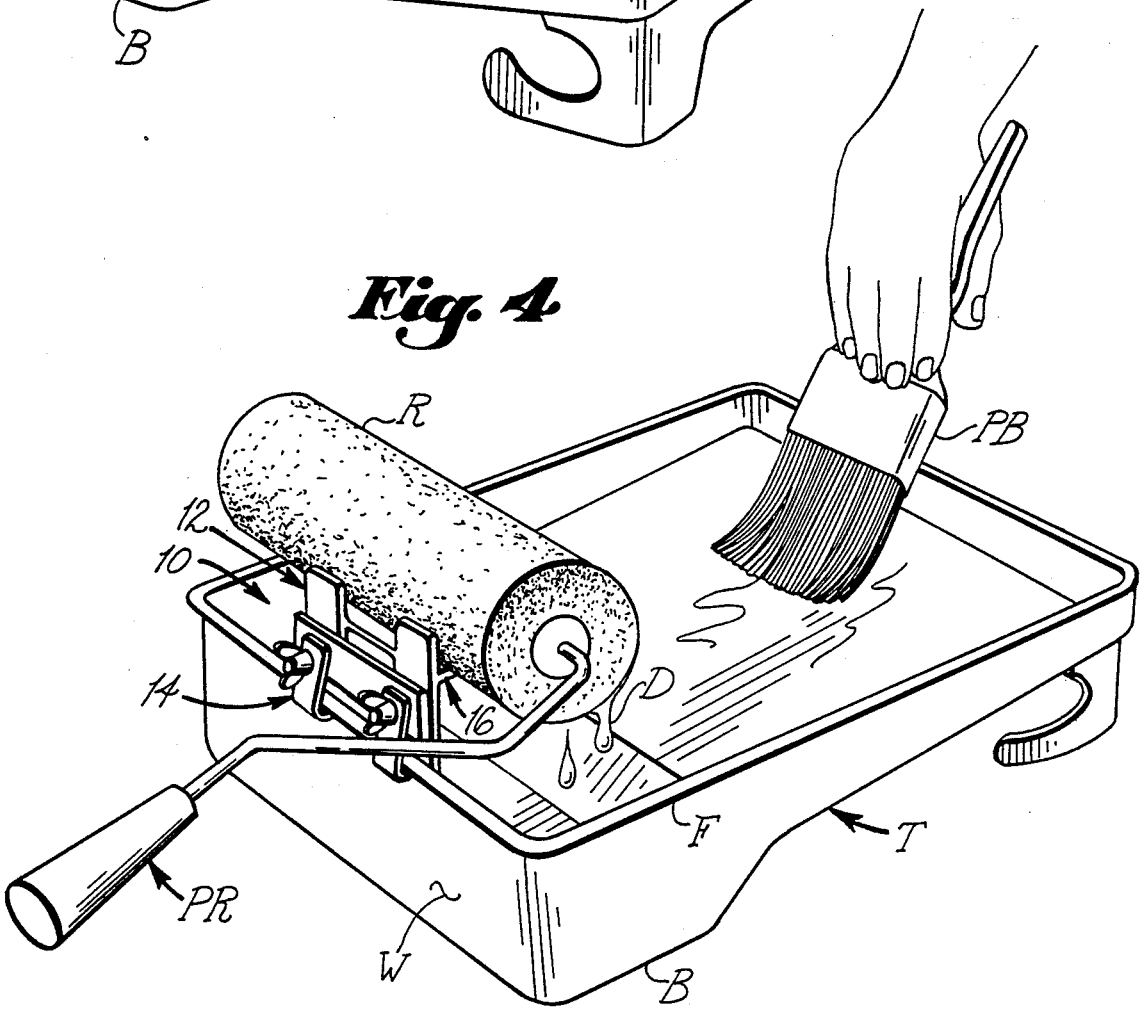
FIG. 4 is a perspective view of the invention in FIG. 1 in another mode of its use.

Referring now additionally to FIGS. 2, 3 and 4, the first and second members 12 and 14 are shown in position installed and attached onto the outwardly extending flange F of the end wall W of a conventional paint tray T. The upright legs 18 and 20 of first member 12 are positioned against the inner surface of end wall W such that the lower distal ends 66 and 68 thereof rest against and receive support from the inner surface of bottom B of tray T. Cooperatively positioned adjacent and against the upright legs 18 and 20 of first member 12 are upright legs 46 and 48 of second member 14. Apertures 56 and 58 of second member 14 are provided to be in alignment and registry with internally threaded bosses 42 and 44 integral with legs 18 and 20 when positioned thusly such that externally threaded wing bolts 70 will clampingly bias the two members 12 and 14 together as best seen in FIG. 2. The lower ends 50 and 52 of legs 46 and 48 are contoured to securely interengage around and beneath flange F, stabilizing the entire assembly 10 for use.

Although standardized, a number of different paint tray depths are available, depending on the diameter of the roller head R. Therefore, as best seen in FIG. 2, the upright legs 18 and 20 of first member 12 are provided with two sets of colinear transversely disposed lines of weakness 38/40 and 39/41. These lines of weakness are intended to facilitate the fracture and detachment of the portions of legs 18 and 20 therebelow, typically shown at 18' in FIG. 1. By this arrangement, then the user may simply fracture along the desired colinear sets of lines of weakness 38/40 to accommodate bottom depth B' or lines 39/41 to accommodate bottom depth B''. Thus, in all cases, the lower ends 66 and 68 of legs 18 and 20 contact, and are supported by, the bottom B, B' or B'', of the paint tray.

Because, during normal use, the paint brush PB and roller head R will still contain a certain amount of paint while it is desired to temporarily rest same atop platform 16, centrally located aperture 60, as best seen in FIG. 1, is provided to facilitate the collectively of drippings D as best seen in FIG. 2 back into the paint tray T. Because platform 16 is disposed over the paint tray T, and facilitated by aperture 60, all dripped paint D is recaptured within the supply of paint within the tray T ready for reuse.

An additional feature of the invention is the elevated positioning of platform 16 above the flange F of paint tray T. The amount of elevation is determined by the overall cooperative lengths of upright portions 18 and 20 of first member 12 and upright legs 46 and 48 of second member 14. By this arrangement, then, as best seen in FIGS. 3 and 4, the user has full access to partially submerge the roller head R into the supply of paint beneath the platform 16 with paint brush PB resting thereatop and, likewise, has full access to the paint reservoir within tray T by paint brush PB when the roller head R of paint roller PR is resting atop platform 16 as seen in FIG. 4.

Figure 5:
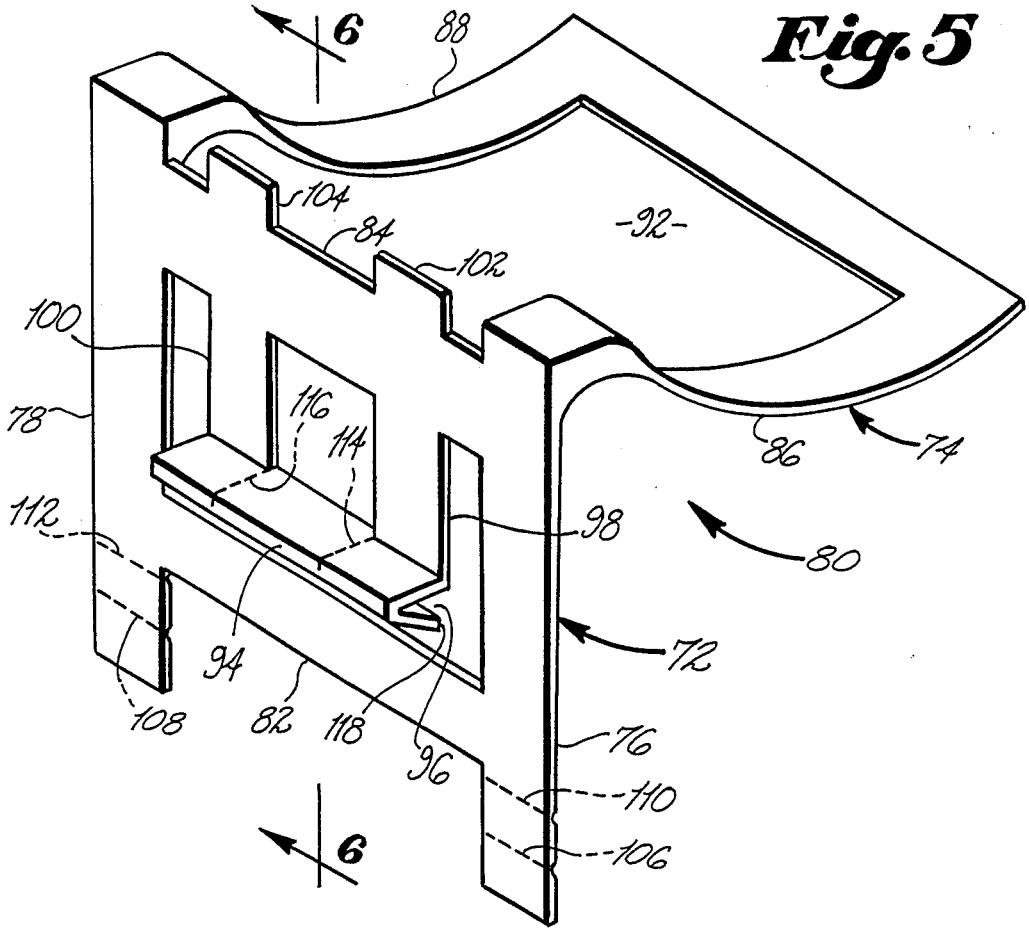
FIG. 5 is a perspective view of the preferred embodiment of the invention.
Figure 6:
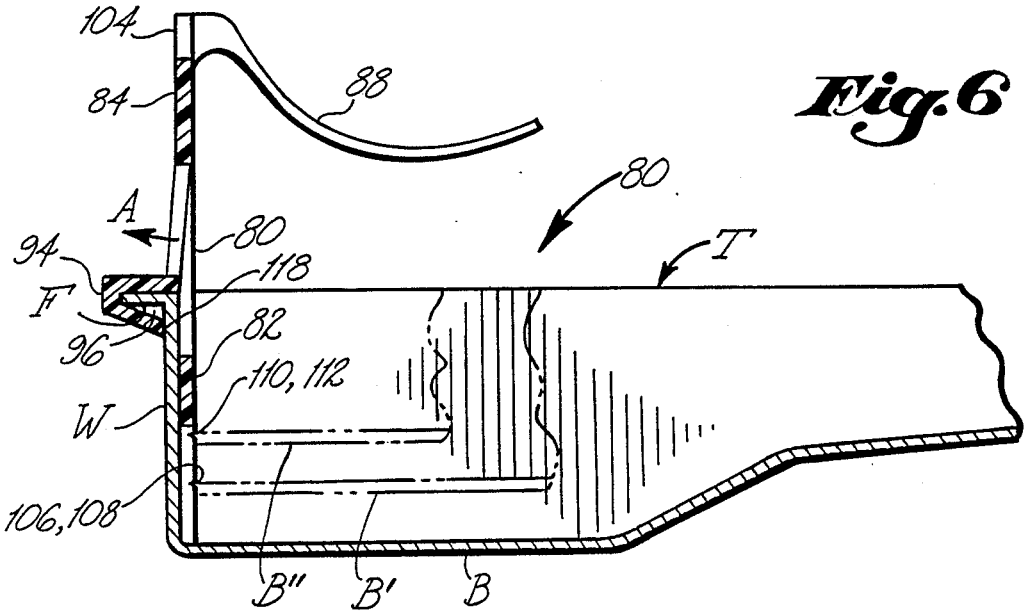
FIG. 6 is a section view in the direction of arrows 6—6 showing the invention connected onto the end wall of a conventional paint tray, other paint tray depths partially shown in phantom.

Referring now to FIGS. 5 and 6, the preferred embodiment of the invention is shown generally at numeral 80 and is integrally molded as one piece of plastic. The holder 80 includes a generally upright molded portion 72 having a pair of elongated, thin legs 76 and 78 disposed and held apart in parallel fashion by transverse members 82 and 84. Laterally extending from the upper ends of legs 76 and 78 is platform 74 which includes platform segments 86 and 88 which are generally curvilinear and concaved upwardly toward platform distal edge 90 as shown. Aperture 92 is provided as previously described to allow drips to fall back into the paint tray T.

Downwardly disposed from upper transverse member 84 are a second pair of legs 98 and 100 which are connected at their lower ends by grooved flange bar 94. This flange bar 94 has a V-shaped longitudinal groove 96 which is structured, as best seen in FIG. 6, to interengage around the outwardly extending flange F disposed from end wall W of paint tray T. By this arrangement, legs 98 and 100 flex in cantilever fashion about transverse member 84 in the direction of arrow A as seen in FIG. 6 such that longitudinal edge 118 of flange bar 94 contacts the outer surface of wall W in biasing fashion, while the lower portions of legs 76 and 78 and transverse bar 82 contact and press against the inner surface of wall W as shown in FIG. 6. This biasing force aids in retaining the device 80 in place during use.

Applicant views as equivalent to the above described structure the elimination of the central portion of flange bar 94 by terminating along dotted lines 114 and 116. Conversely, legs 98 and 100 may be eliminated and replaced only with the central portion of flange bar 94 between dotted lines 114 and 116 extending upwardly to integrally join transverse member 84 thus also functioning in cantilever fashion as previously described to interengage around flange F.

Legs 98 and 100 upwardly extend at 102 and 104 to form a notch 84 which is adapted to supportively receive and laterally retain the handle of the paint brush. Thus, in this embodiment, the bristles of the paint brush are supported along bar 90, while the handle of the paint brush is intended for positioning in notch 84.

As was previously described with respect to FIGS. 1 to 4, upright legs 76 and 78 are provided with two sets of colinear transversely disposed lines of weakness 106/108 and 110/112. Again, these lines of weakness are intended to facilitate the fracture and detachment of the portions of the upright legs 76 and 78 therebelow.

It is here noted that, although the preferred embodiment of the invention 80 depends on the cantilever biasing of legs 98 and 100 so as to place inwardly directed spring biasing force on flange F and the inner surface of wall W by flange bar 94 and upright legs 76 and 78, respectively, this biasing feature may be alternately replaced laterally by a flange engaging bar similarly positioned but not biasingly against flange F and whereby platform 74 is weighted sufficiently, particularly along member 90 so as to rely primarily on the force of gravity to hold the invention in position for use. Additionally, either the placement of a paint brush or a paint roller in temporarily stored position atop platform 74 enhances the overall stability of the arrangement in use.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A paint brush and paint roller holder structured to be releasably connectable onto an upright end wall of a paint tray comprising:

a molded member having at least one pair of elongated, relatively thin legs held generally upright and also having a generally horizontal platform positioned directly above the tray formed by a lateral extension from adjacent the upper end of said legs;

said molded member also including means for engaging around an outwardly extending paint tray flange;

said molded member also including means for laterally restraining a paint brush or paint roller placed generally horizontally atop said platform;

said legs having a distal end extending downwardly sufficiently to contact and receive support from the inner surface of the paint tray bottom and extending upwardly sufficiently to position said platform above the paint tray flange to allow free access to the liquid paint contents of the tray by either paint brush or paint roller;

said platform structured and positioned over the paint tray to allow liquid paint to drip from the paint brush and paint roller downwardly directly into the paint tray;

said leg includes at least one colinear line of weakness disposed transversely across said leg;

said line of weakness adapted to facilitate separation of the portion of said leg therebelow;

said line of weakness positioned transversely above said distal end to shorten said leg to accommodate shallower paint trays.

2. A paint brush and paint roller holder as set forth in claim 1, wherein:

said molded member is plastic.

3. A paint brush and paint roller holder adapted to be releasably connectable onto an upright end wall of a paint tray comprising:

an integrally molded member having a first pair of elongated, relatively thin legs connected and held in generally spaced apart, coplaner, upright relation and also having a generally horizontal platform positioned above the tray formed by lateral extensions from each upper end of each of said first pair of legs;

said molded member having at least one elongated, relatively thin second leg disposed between said first pair of legs and connected at one end and held in generally spaced apart, coplaner upright relation;

said second leg having a transverse groove at its free end structured to engage around the outwardly extending paint tray flange;

said first pair of legs and said second leg opposingly cooperating to supportively engage against the inside end wall surface and the flange of the paint tray, respectively;

said platform structurally contoured along its length to receive and laterally support a paint roller head placed atop said platform;

said second leg upwardly extending and cooperating with an opposing upwardly turned distal margin of said platform to support and laterally restrain a paint brush.

4. A paint brush and paint roller holder as set forth in claim 3, wherein:

said leg has a distal end extending downwardly sufficiently to contact and receive support from the inner surface of the paint tray bottom and extends upwardly sufficiently to position said platform above the paint tray flange sufficiently to allow free access to the liquid paint contents of the tray by either paint brush or paint roller.

5. A paint brush and paint roller holder as set forth in claim 4, wherein:

said platform is structured to allow liquid paint to drip from the paint brush and paint roller downwardly into the paint tray.

6. A paint brush and paint roller holder as set forth in claim 5, wherein:

said leg includes at least one line of weakness disposed transversely across said leg;

said line of weakness adapted to facilitate separation of the portion of said leg therebelow;

said line of weakness positioned along the length of said leg to shorten it to accommodate shallower paint trays.

7. A paint brush and paint roller holder as set forth in claim 6, wherein:

said molded member is plastic.

8. A paint brush and paint roller holder adapted to be releasably connectable onto the upright end wall of a paint tray comprising:

a first molded member having a first pair of elongated, relatively thin legs connected and held in generally spaced apart, coplaner, upright relation and also having a generally horizontal platform positioned above the tray and formed by the extensions from adjacent the upper ends of each of said first pair of legs;

a second molded member having a second pair of elongated, relatively thin legs connected and held in generally spaced apart, coplaner, upright relation;

each of said second pair of legs adapted at their lower ends to engage around the outwardly extending paint tray flange;

said first and second pairs of legs each having at least one aperture in alignment and registry one to another for receiving a clamping member cooperatively adapted to draw said first and second pairs of legs toward one another and supportively against the inside end wall surface and the flange of the paint tray respectively;

said first pair of legs extending above said platform and cooperating with opposing upwardly turned distal ends of said extensions to laterally restrain a paint brush placed generally horizontally atop said platform;

said platform structured to receive and laterally support a paint roller head placed generally horizontally atop said platform;

each of said first pair of legs having a distal end extending downwardly sufficiently to contact and receive support from the inner surface of the paint tray bottom and extends upwardly sufficiently to position said platform over and above the paint tray flange sufficiently to allow free access to the liquid paint contents of the tray by either paint brush or paint roller;

said extensions spaced apart to allow liquid paint to drip from the paint brush and paint roller directly downwardly into the paint tray.

9. A paint brush and paint roller holder as set forth in claim 8, wherein:

said pair of legs includes at least one pair of colinear lines of weakness each of which is disposed transversely across each leg of said first pair of legs;

each said line of weakness adapted to facilitate separation of the portion of each leg of said first pair of legs therebelow;

each said pair of lines of weakness positioned along the length of said first pair of legs to shorten them to accommodate shallower paint trays.

10. A paint brush and paint roller holder as set forth in claim 9, wherein:

each of said first and second molded members are plastic.

11. A paint brush and paint roller holder as set forth in claim 10, wherein:

each said clamping member is an externally threaded bolt;

each said aperture in said first pair of legs is internally threaded to receive said threaded bolt.

* * * * *